US006473916B2

(12) United States Patent
Schiødt

(10) Patent No.: US 6,473,916 B2
(45) Date of Patent: Nov. 5, 2002

(54) SHOWER HOLDING DEVICE FOR FIXATING A SHOWERHEAD IN A SPECIFIC POSITION ON A WALL SLIDE BAR

(75) Inventor: Leif Villy Schiødt, Allerød (DK)

(73) Assignee: Johs. Tandrup Metalvarefabrik ApS, Allerød (DK)

( * ) Notice: Subject to any disclaimer, the term of this patent is extended or adjusted under 35 U.S.C. 154(b) by 0 days.

(21) Appl. No.: 09/871,218

(22) Filed: May 31, 2001

(65) Prior Publication Data

US 2002/0016988 A1 Feb. 14, 2002

(30) Foreign Application Priority Data

May 31, 2000 (EP) ..... 00610055

(51) Int. Cl.[7] ..... A47K 3/20
(52) U.S. Cl. ..... 4/567; 4/605; 4/615; 4/570
(58) Field of Search ..... 4/567, 568, 570, 4/605, 615; 248/222.11, 222.12, 230.1, 297.51

(56) References Cited

U.S. PATENT DOCUMENTS

| | | | | | |
|---|---|---|---|---|---|
| 5,265,833 | A | * | 11/1993 | Heimann et al. | 4/615 |
| 5,277,391 | A | * | 1/1994 | Haug et al. | 4/605 |
| 5,704,080 | A | * | 1/1998 | Kuhne | 4/567 |
| 6,024,331 | A | * | 2/2000 | Bischoff et al. | 4/615 |
| 6,050,508 | A | * | 4/2000 | Fan | |
| 6,123,308 | A | * | 9/2000 | Faisst | 4/605 |
| 6,199,227 | B1 | * | 3/2001 | Chen | 4/615 |

FOREIGN PATENT DOCUMENTS

| | | | | |
|---|---|---|---|---|
| DE | 2535891 | A1 | * | 2/1977 |
| DE | 2804618 | A1 | * | 8/1979 |
| GB | 2176390 | A | | 12/1986 |
| GB | 2202131 | A | | 9/1988 |
| JP | 5-331889 | A | * | 12/1993 |
| JP | 6-173305 | A | * | 6/1994 |

* cited by examiner

*Primary Examiner*—Gregory Huson
*Assistant Examiner*—Khoa D. Huynh
(74) *Attorney, Agent, or Firm*—Howard J. Klein

(57) ABSTRACT

A device for fixing a showerhead in a position on a wall slide bar includes a casing having top and bottom surfaces each extending transversely relative to the longitudinal direction of the bar and having cylindrical bore through the casing for receiving the bar. The device includes a brake pad that is engageable with the bar, and first and second pushbuttons, each of which is operable on the pad to engage the pad in a first position to engage the bar to fix the device in a specific position on the bar, and in a second position to disengage the pad from the bar, allowing the device to be moved longitudinally along the bar. The first pushbutton is in the top surface of the casing and is pressed in a first direction parallel to the longitudinal direction of the bar and toward the bottom surface of the casing to move from its first position to its second position. The second pushbutton is in the bottom surface of the casing and is pressed in a second direction parallel to the longitudinal direction of the bar and toward the top surface of the casing to move from its first position to its second position.

10 Claims, 3 Drawing Sheets

Figures 1A, 1B:
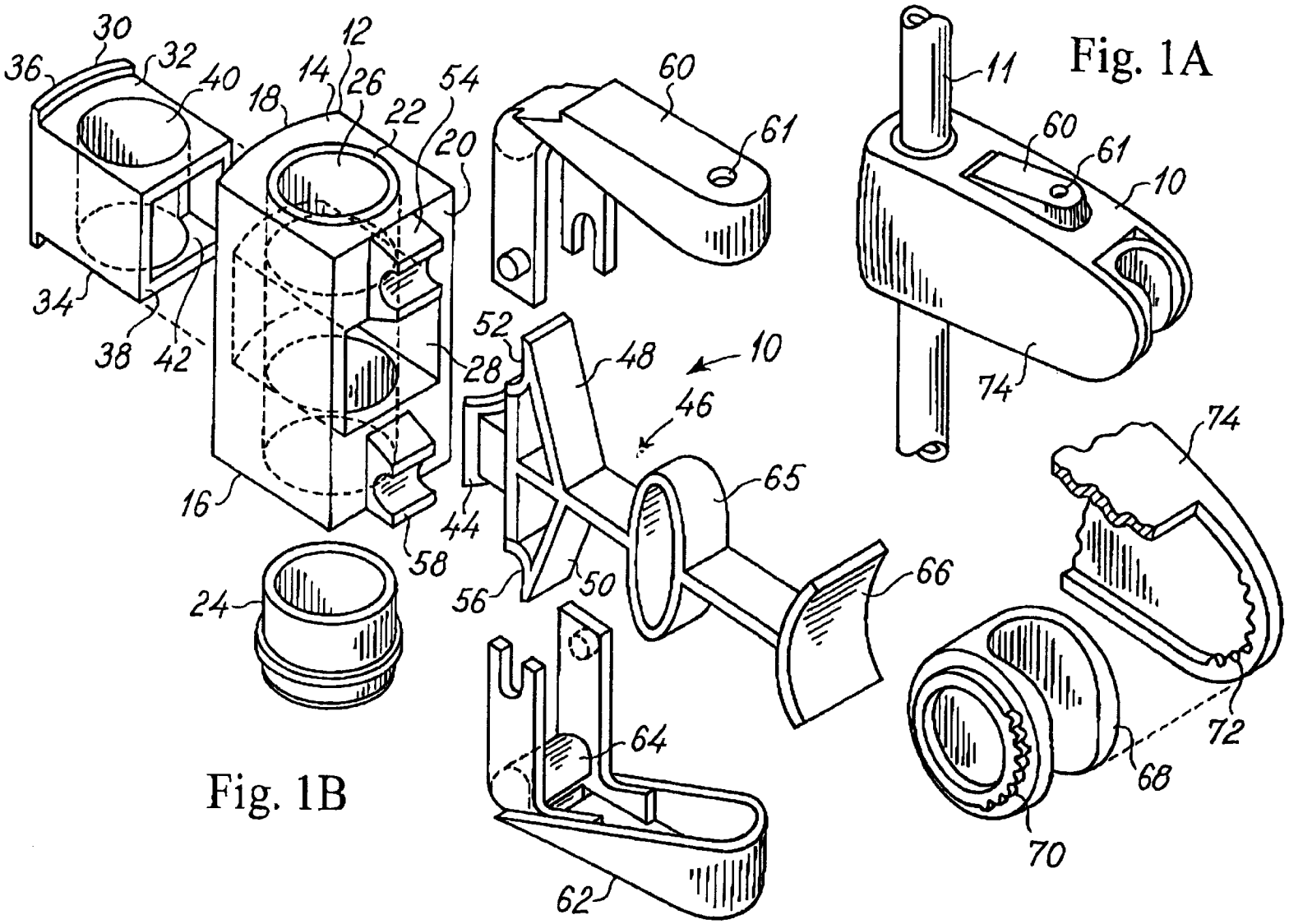

SHOWER HOLDING DEVICE FOR FIXATING A SHOWERHEAD IN A SPECIFIC POSITION ON A WALL SLIDE BAR

The present invention in particular relates to a shower holding device for fixating a showerhead in any given position along the longitudinal axis of a wall slide bar. Especially the invention relates to a shower holding device releasably fixated to a wall slide bar, which shower holding device in released mode allows movement of shower holding device along the wall slide bar.

The state of the art technology is described in German patent application no. DE 28 57 859 disclosing a shower holder for mounting on a wall slide bar. This shower holder is fixated to the wall slide bar through a turn knob cooperating with braking means engaging on to the wall slide bar. Fixation or release of this shower holder generally requires the use of both hands. One hand for releasing the turn knob and one hand for moving the shower holder along the wall slide bar.

Further state of the art technology is described in European patent no. EP 0 607 877 disclosing a slider for a wall bar. This slider includes a sliding element constructed as a sliding ring having a bearing face with ribs running in the longitudinal direction of the bar and limiting the forming of tracks caused by moving the slider along the wall bar.

Further state of the art technology is described in European patent application no. EP 0 731 229 disclosing a shower holder wherein the showerhead is mounted in a conical receiving section of the shower holder. The receiving section of the shower holder includes an axial slit so as to allow for easy positioning of the showerhead in the receiving section and so as to allow for easy removal of the showerhead from the receiving section. Particularly relevant in this context is the embodiment shown in FIG. 1 of the European patent application no EP 0 731 229, showing a shower holder, which is fixated to a wall slide bar and which is released from a particular position by pressing one button in one direction. This embodiment, however, does not provide for single handed operation of the shower holder since movement of the shower holder in a downward direction requires the use of both hands. One hand for pressing the button in the upwardly direction and one hand for pressing the shower holder in the downward direction.

Further state of the art technology is described in British patent no. GB 20 19 176 disclosing a shower holder fixated to a specific location along a wall bar and releasable from the specific location by means of a wing nut. The wing nut simultaneously releases the shower holder for movement along the wall bar and releases the shower holder for angular rotation of the showerhead positioned in the shower holder. Similarly to the shower holders described above this particular shower holder requires two hands for its operation.

Additional state of the art technology is described in European patent no. EP 0 504 749 disclosing a shower holder for a wall-slidebar having particular geometric dimensions ensuring that the shower holder stays in a specific location along the wall-slidebar. Particular relevant in this context is the embodiment shown in FIG. 5 of the European patent EP 0 504 749, showing a shower holder having one pushbutton engaging and disengaging a braking element.

Finally state of the art technology is described in German patent application no. DE 25 35 891 disclosing a shower holder having one button positioned extending perpendicular to the longitudinal axis of a wall bar. The positioning of the button requires that the operator of the shower holder firstly applies a force for pressing be button and secondly applies an additional force for moving of the shower holder along the wall bar.

The above referenced patents and patent applications provide a shower holder having means for fixating the shower holder to a wall bar, which means are operable through the turning of a knob or wing nut, or through pressure applied to one button. The pressure applied by an operator of any of the shower holders according to above reference patents and patent application generally is generally not utilized for moving the shower holder.

An object of the present invention is therefor to provide a shower holding device that ensures fixation of the shower holding device at a specific location on a wall slide bar by utilisation of braking means controllable through co-operating pushbuttons located on opposite sides of the shower holding device. The action or displacement of the pushbuttons is further in a direction parallel to the longitudinal direction of the wall slide bar and thus in the direction of movement along the wall slide bar.

A further object of the present invention is to provide a shower holding device, which locks angular rotation of a showerhead relative to the longitudinal axis of the wall slide bar while braking means are disengaged from the wall slide bar thus allowing for movement of the shower holding device along the wall slide bar.

A particular advantage of the present invention is the fact that the shower holding device according to the present invention allows for single handed operation of the shower holding device since an operator may single handed and in one operation release the braking means of the shower holding device and shift the position of the shower holding device.

The above objects, the above advantage and the above feature together with numerous other objects, advantages and features which will be evident from below detailed description of a preferred embodiment of the present invention is according to a first aspect of the present invention obtained by a shower holding device for fixating a showerhead in a specific position along the longitudinal direction of a wall slide bar, said shower holding device comprising:

(a) a casing defining a top surface and a bottom surface each extending transversely relative to said longitudinal direction of said wall slide bar and having an open ended cylindrical bore extending through said casing from said top surface to said bottom surface for receiving said wall slide bar, (b) braking means engaging with said wall slide bar thereby fixating said shower holding device at said specific position along said longitudinal direction of said wall slide bar, (c) a set of parallelly acting pushbuttons independently co-operating with said braking means and each of said set of parallelly acting pushbuttons engaging in a first position said braking means for fixating said shower holding device at said specific position along said longitudinal direction of said wall slide bar and disengaging in a second position said braking means for allowing movement of said shower holding device along said longitudinal direction of said wall slide bar, and said set of pushbuttons being constituted by a first pushbutton located on said top surface of said casing and a second pushbutton located on said bottom surface of said casing, said first pushbutton being depressible in a first direction substantially parallel to said longitudinal direction of said wall slide bar and toward said bottom surface of said casing for obtaining said second position of said first pushbutton and said second pushbutton being depressible in a second direction substantially parallel to said longitudinal direction of said wall slide bar and toward said top surface of said casing for obtaining said second position of said second pushbutton.

In the preferred embodiment according to the first aspect of the present invention the set of parallely acting pushbuttons enable an operator to simply provide pressure on either the first or second pushbutton, which pressure subsequently may be utilised for the movement of the shower holding device when the braking means have been disengaged. This feature significantly simplifies operation of the shower holding device since the preferred embodiment of the present invention maintains a firm fixation of the shower holding device while the braking means are engaged and provides easy movement of the shower holding device having disengaged braking means accomplished with a single operation The preferred embodiment according to the first aspect of the present invention further comprises introducing a force exerted on the first or the second pushbutton for depressing each of the set of pushbuttons in the second position for disengaging the braking means, which force is larger than the frictional force between the wall slide bar and the shower holding device when the braking means are disengaged. Consequently depressing the first pushbutton in the second position disengages the braking means and causes movement of the shower holding device in the second direction and depressing the second pushbutton in the second position disengages the braking means and causes movement of the shower holding device in the first direction.

In the preferred embodiment according to a first aspect of the present invention the wall slide bar may have a rectangular, triangular, elliptic, circular, semi-elliptic, or semicircular shaped cross section or may have a cross section having a shape of combinations thereof, preferably the wall slide bar has a circular cross section. Any cross sectional shape is generally acceptable thus providing any customised variations incorporated in the present invention. Furthermore, the wall slide bar may be constructed in a plastic material such as ABS, PP, PE or PU or may be constructed in a metal material such as aluminium, iron or steel or any combinations thereof. Additionally, the casing may be constructed in a plastic material such as ABS, PP, PE or PU or may be constructed in a metal material such as aluminium. iron or steel or any combinations of plastic materials and metal materials. The casing and the wall slide bar may generally be constructing in any material having a coating or a protective layer ensuring that the casing and/or the wall slide bar against corrosion and maintaining a stable construction capable of resisting unintentional or intentional jerks of the showerhead.

Damages to the shower holding device caused by rough handling may be limited by a shower holding device further comprising bushing means for mounting in the open ended cylindrical bore, which bushing means may have an inner bore with a cross sectional shape snugly matching a cross sectional shape of the wall slide bar. By introducing brushings a mobility of the shower holding device along the wall slide bar is achieved while play of the shower holding device in a direction perpendicular to the longitudinal direction of the wall slide bar is avoided. Thus increasing stability of the shower holding device and preventing damages caused by pulling of the shower holding device or pulling of components connected to the shower holding device.

The first and second pushbuttons of the preferred embodiment according to the first aspect of the present invention may co-operate with the braking means through a pair of axles having asymmetrical cross sections so that adding pressure to the first and/or second pushbuttons induces rotation of the pair of axles providing a first displacement of the braking means to engage the wall slide bar in the first position of the first and/or second pushbuttons and so that releasing pressure on the first and second pushbuttons induces rotation of the pair of axles providing a second displacement of the braking means to disengage the wall slide bar in the second position of the first and second pushbuttons Co-operation between the first and/or second pushbutton and the braking means may be implemented in a wide variety of ways e.g. mechanical couplings or transmission or electronically acting actuators. Any of these implementations of the co-operation is attainable without extending beyond the scope of the preferred embodiment according to the present invention.

The showerhead for the preferred embodiment according to a first aspect of the present invention may be received in a revolving shower holder having teeth extending outwardly from the revolving shower holder into matching teeth in the casing so as to enable angular fixation of the showerhead The showerhead may thus be positioned and maintained in a series of predetermined angular positions providing the operator the possibility to choose any desired direction of the water ejected from showerhead. This feature of the shower holding device further improves the shower holding device since the angular orientation of the showerhead relative to the longitudinal axis of the wall slide bar has become adjustable without introducing a separate bolting or locking mechanism for maintaining the showerhead in one particular angular orientation thus introducing further unnecessary costs to the preferred embodiment The braking means of the preferred embodiment according to a first aspect of the present invention may comprise a first braking pad engaging the wall slide bar in the first position of the first and/or second pushbuttons and may comprise a second braking pad providing fixture of the showerhead so that the first displacement of the braking means provides fixation of the shower holding device along the longitudinal direction of the wall slide bar and enables angular stepwise rotation of the showerhead and so that the second displacement of the braking means provides movement of the shower holding device along the longitudinal direction of the wall slide bar and angular fixation of the showerhead. This feature is particularly advantageous since locking of the showerhead during moving of the shower holding device along the wall slide bar prevents that water from the showerhead is directed in any undesired direction. The feature prevents rotation of the showerhead induced by pulling the shower holding device away from a mixing fitting connected to the showerhead through the hose. The length of the hose determines a maximum displacement of the shower holding device along the wall slide bar. Any attempt to displace the shower holding device beyond this maximum will in the state of the art technology tend to rotate the showerhead thus spreading water in an outwardly direction away from the wall slide bar.

The showerhead utilised in the preferred embodiment according to the first aspect of the present invention may comprise a showerhead connector for connecting the showerhead to a hose. The showerhead connector may have a conical shaped open ended first part defining a first end diameter larger than a second end diameter, may have the first part axially fixated at the second end diameter to the hose by utilising a hose section defining an end surface having a larger diameter than the second end diameter, may have a plurality of washers or spacers interconnecting the hose section with the showerhead, and may have the first part connected to the showerhead at the first end diameter. The plurality of washers or spacers seals the connector and simultaneously enables axial rotation of the showerhead relative to the hose. The object is to allow free rotation of the showerhead along the axis of the hose thus adding an additional flexibility to the showerhead ensuring that the hose continuously unwinds and thus any twisting of the hose is eliminated.

The above objects, above advantages and above features together with numerous other objects, advantages and features which will be evident from below detailed description of a preferred embodiment of the present invention is according to a second aspect of the present invention obtained by a shower holding assembly comprising (a) a hose for connecting to a water mixing fitting, (b) a showerhead for ejecting water, (c) a connector for connecting said showerhead to said hose, (d) a wall slide bar for in particular mounting on a wall in a bath room, (e) a shower holding device for fixating said showerhead in a specific position along the longitudinal direction of said wall slide bar, said shower holding device comprising:

(i) a casing defining a top surface and a bottom surface each extending transversely relative to said longitudinal direction of said wall slide bar and having an open ended cylindrical bore extending through said casing from said top surface to said bottom surface for receiving said wall slide bar, (ii) braking means engaging with said wall slide bar thereby fixating said shower holding device at said specific position along said longitudinal direction of said wall slide bar, (iii) a set of parallel acting pushbuttons independently co-operating with said braking means and each of said set of parallel acting pushbuttons engaging in a first position said braking means fixating said shower holding device to said specific position along said longitudinal direction of said wall slide bar and disengaging in a second position said braking means allowing movement of said shower holding device along said longitudinal direction of said wall slide bar, and said set of pushbuttons being constituted by a first pushbutton located on said top surface of said casing and a second pushbutton located on said bottom surface of said casing, said first pushbutton being depressible in a first direction substantially parallel to said longitudinal direction of said wall slide bar and toward said bottom surface of said casing obtaining said second position of said first pushbutton and simultaneously causing movement of said casing in said first direction and said second pushbutton being depressible in a second direction substantially parallel to said longitudinal direction of said wall slide bar and toward said top surface of said casing obtaining said second position of said second pushbutton and simultaneously causing movement of said casing in said second direction.

The shower holding assembly of the preferred embodiment according to the second aspect of the present invention comprises features as described with reference to the preferred embodiment according to the first aspect.

Figure 2:
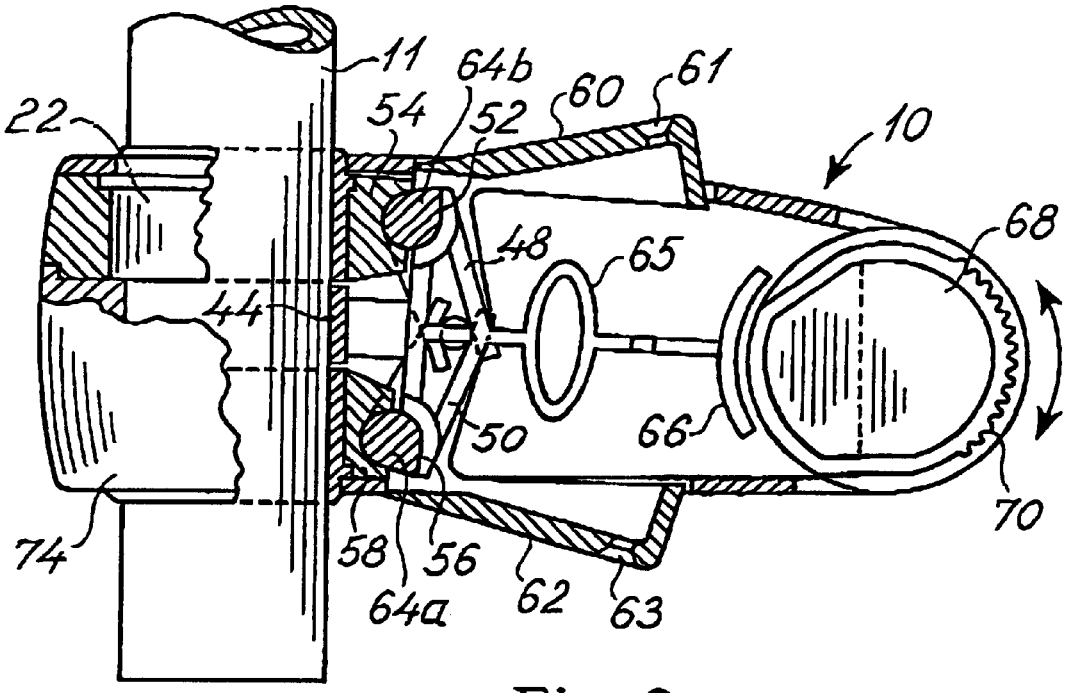
Figure 3:
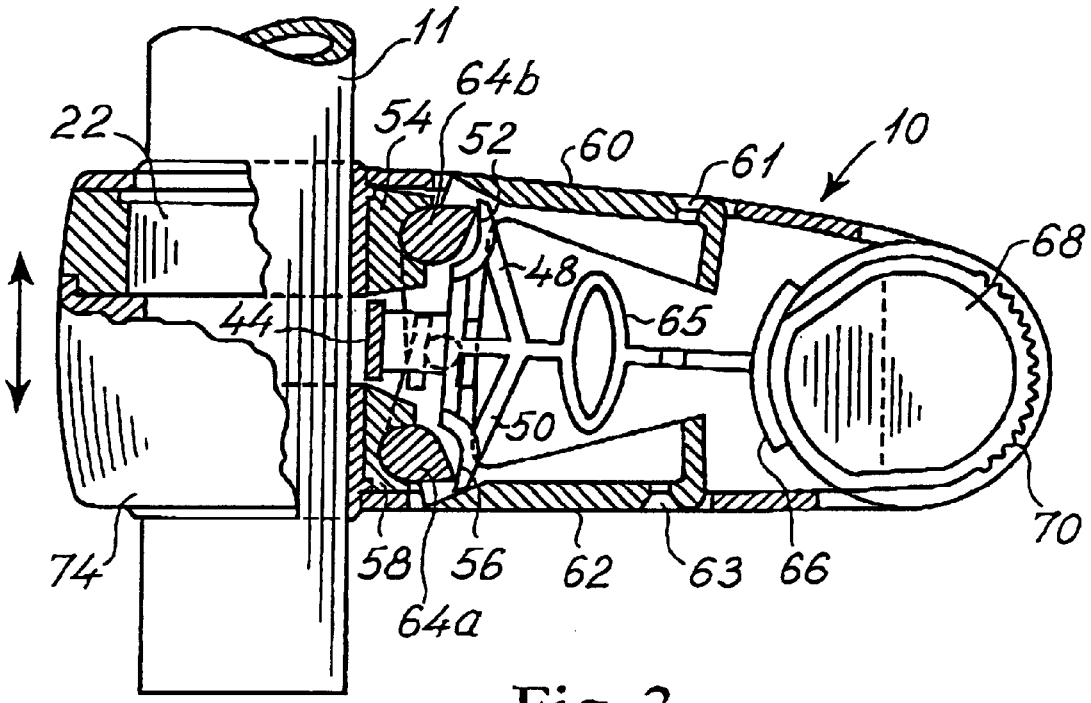
Figure 4A:
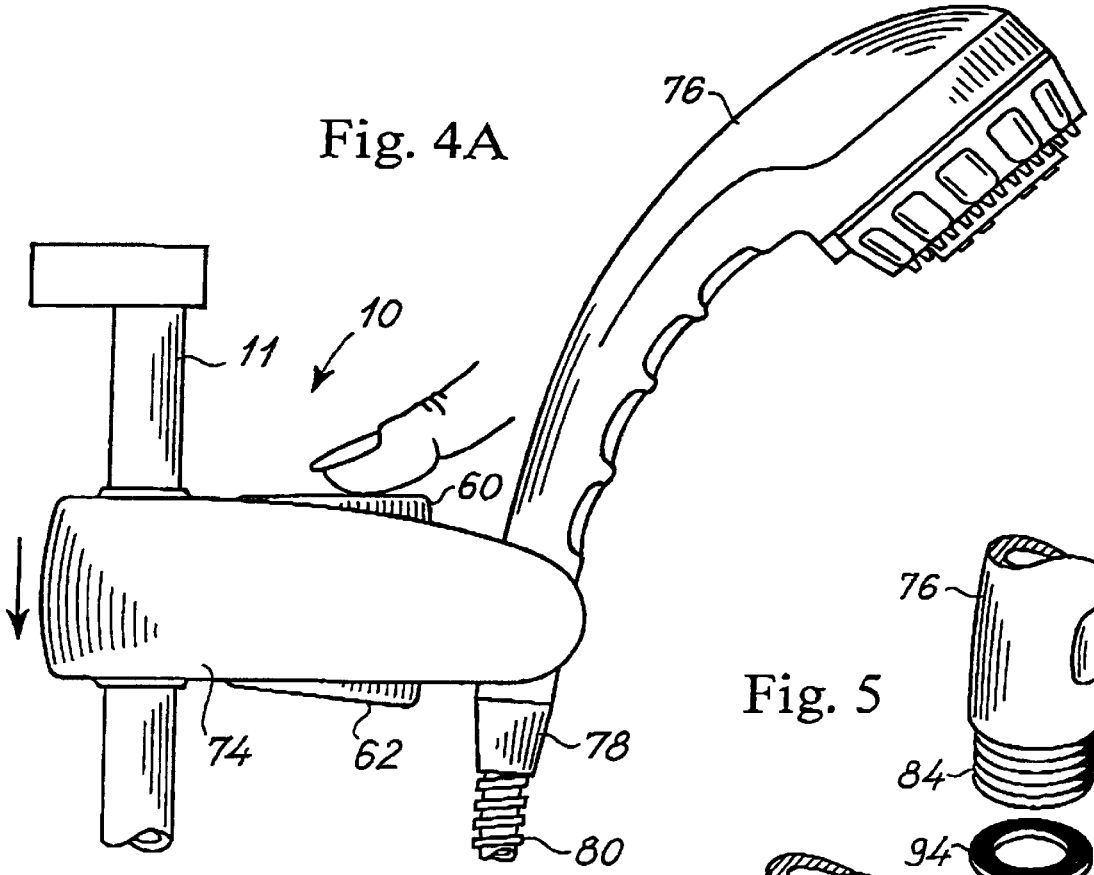
Figure 4B:
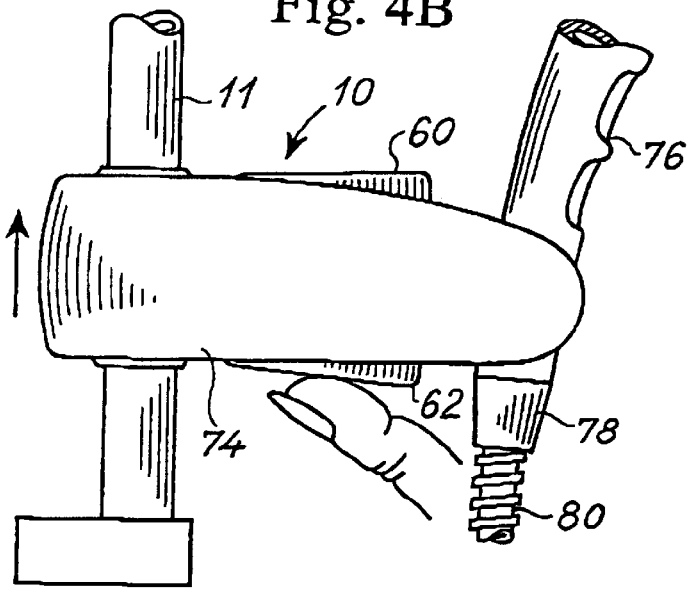
Figure 5:
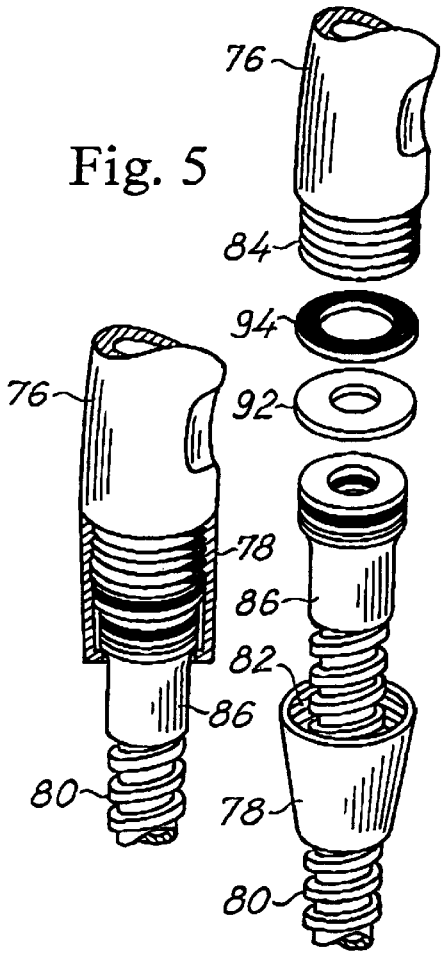

The present invention is below described in detail with reference to figures where;

FIG. 1A, shows a three dimensional view of a shower holding device according to the present invention, FIG. 1B, shows a three dimensional cut away and exploded view of the shower holding device according to the present invention, FIG. 2, shows a cut away cross sectional view of a shower holding device according to the present invention being mounted on a wall slide bar and having a braking mechanism engaged locking axial movement of the shower holding device, FIG. 3, shows a cross sectional view of a shower holding device according to the present invention being mounted on a wall slide bar and having a braking mechanism locking disengaged allowing axial movement of the shower holding device, FIG. 4A, shows a two dimensional view of the shower holding device in particular depicting operation of the shower holding device in a downward direction by the application of pressure to a pushbutton on the top surface of the shower holding device, FIG. 4B, shows a two dimensional view of the shower holding device in particular depicting operation of the shower holding device in a upward direction by the application of pressure to a pushbutton on the bottom surface of the shower holding device, and FIG. 5, shows a three dimensional cut away view of the showerhead connector and a three dimensional explode view of the showerhead connector.

FIG. 1A, shows a shower holding device according to the present invention designated in its entirety by numeral 10, which shower holding device 10 provides means for holding a showerhead in a fixed position along a wall slide bar 11 and allows for sliding of the shower holding device 10 along the wall slide bar 11.

FIG. 1B shows a cut away and exploded view of the shower holding device 10. The shower holding device 10 comprises a housing 12 defining a top side 14, a bottom side 16, back side 18 and front side 20. The housing 12 receives a pair of bushings 22, 24 in a cylindrical circular bore 26 extending through the housing 12 from the top side 14 to the bottom side 16. The bushings 22, 24 provide a snug fit for the wall slide bar 11 so as to allow for movement of the shower holding device 10 along the wall slide bar 11. The bushings 22, 24 may in an alternative embodiment of the present invention be consist of a single unitary bushing extending from the top side 14 to the bottom side 16 of the housing 12.

The housing 12 further comprises a rectangular bore 28 for receiving a third bushing 30 from the back side 18 to the front side 20 of the housing 12. The third bushing 30 has a rectangular outer surface matching to a snug fit the rectangular bore 28 and defines a top side 32, a bottom side 34, a back side 36 and a front side 38. The third bushing 30 further has a cylindrical circular bore 40 extending through the third bushing 30 from the top side 32 to the bottom side of the third bushing 30. The diameter of the cylindrical circular bore 40 of the third bushing 30 is identical to the inner diameter of the two bushing 22, 24 in the housing 12. Hence the cylindrical circular bore 40 provides a snug fit for the wall slide bar 11. Additionally, the third bushing 30 has a cylindrical bore 42 extending from the front side 38 of the third bushing 30 to the cylindrical circular bore 40, which cylindrical bore 42 allows access and receives braking pad 44. During fixation of the shower holding device along the wall slide bar 11 the braking pad 44 is pushed against the wall sliding bar through the cylindrical bore 42 thus preventing movement of the shower holding device along the wall slide bar 11.

The braking pad 44 is mounted on a moveable part designated in its entirety by numeral 46 The moveable part 46 comprises two arms 48, 50. The one arm 48 extends from the moveable part 46 in a direction toward the top side 14 of the housing 12 and includes a first curved section 52 in a position opposite to a first bearing 54 having a semicircular recess placed on the front side 20 of the housing 12. Similarly the second arm 50 extends from the moveable part 46 in a direction toward the bottom side 16 of the housing 12 and includes a second curved section 56 in a position opposite to a second bearing 58 having a semicircular recess placed on the front side 20 of the housing 12.

The braking pad 44 is activated and released through movement of the moveable part 44. The release is accomplished by inducing movement of the moveable arm 46 in a direction away from the front side 20 of the housing. This movement of the moveable arm 46 is induced through depressing either of buttons 60, 62 The buttons 60, 62 each include an axle 64 (*a, b*) on one side being received in the bearings 54, 58 and on the other side being in contact with the first and second curved sections 52, 56 of the moveable part 46. The axles 64 (*a, b*) on each of the buttons 60, 62 have asymmetrical shaped cross sections. Hence the depressing of either of the buttons 60, 62 rotates the respective axle 64 (*a, b*) so that the distance between the first or second curved sections 52, 56 depending on which button 60 62 is depressed increases moving the moveable part 46 away from the housing 12. In this manner the braking pad 44 is move away from the wall slide bar 11 and allowing movement of the shower holding device 10 along the wall slide bar 11.

The buttons 60, 62 are positioned on a surface parallel to the top side 14 surface of the housing 12 and on a surface parallel to the bottom side 16 surface of the housing 12. Thus the operator of the shower holding device 10 may easily move the shower holding device 10 with one hand in a direction along the wall slide bar 11. By depressing the top button 60 the operator simply may move the shower holding device 10 in the direction of the pressure applied. Oppositely the by depressing the bottom button 62 the operator simply may move the shower holding device 10 in the other direction. However, the operator additionally may obviously move the shower holding device 10 in any direction he desires when depressing either button 60, 62.

Furthermore, the buttons 60 and 62 include holes 61 and 63 for providing an opportunity for inserting a cable extending through both holes 61 and 63 so as to allow an operator the possibility to activate the button 60 through pulling in the cable.

The moveable part 46 further comprises a center section 65 having a substantially oval shape and providing absorption of compression strain in the moveable arm 46. A second braking pad 66 extends from the center section 65 and provides braking of a revolving shower holder 68 for holding the showerhead when either of the buttons 60, 62 is depressed. The center section 65 absorbs compression strain while either of the buttons 60, 62 is depressed and thus while the second braking pad 66 is pressed against the revolving shower holder 68.

The revolving shower holder 68 comprises a series of teeth 70 for allowing stepwise angular changes of the shower. The series of teeth 70 are interlocked with a corresponding series of teeth 72 positioned on a casing 74 shown only partly in FIG. 1B. While the operator moves the shower holding device 10 in either direction by depressing any of the buttons 60, 62 as mentioned above the second braking pad 66 is pushed toward the revolving shower holder 68. Hence the second braking pad 66 presses the interlocking series of teeth 70, 72 together disabling any rotation of the revolving shower holder 68.

FIG. 2, shows the shower holding device 10 having the braking pad 44 engaging the wall slide bar 11 and thus fixating the shower holding device 10 to the wall slide bar 11 preventing any movement of the shower holding device 10 along the wall slide bar 11. As shown in FIG. 2 the asymmetrical axles 64 (*a, b*) in this position provides a minimum distance between the curved sections 52, 56 and the bearings 54, 58. The axles 64 (*a, b*) are shaped like droplets for providing a smooth rotation while depressing either of the buttons 60,62 or by pulling a cable extending through the holes 61 and 63.

FIG. 3, shows the shower holding device 10 having the braking pad 44 disengaged from the wall slide bar 11 and thus allowing movement of the shower holding device 10 along the wall slide bar 11. When depressing either of the buttons 60, 62 the respective axles 64 (*a, b*) rotate and the droplet shaped axles 64 (*a, b*) turn the pointed end of the droplet shaped axles 64 (*a, b*) toward the curving sections 52, 56 and by doing so increasing the distance between the curved sections 52, 56 and the bearings 54, 58. The increase in distance shifts the moveable arm 46 away from the wall slide bar 11 and towards the revolving shower holder 68 thus disengaging the braking pad 44 and engaging the second braking pad 66. The affect of shifting the moveable arm 46 in the direction of the revolving shower holder 68 is locking the revolving shower holder 68 at a fixed orientation so as to lock the showerhead in one particular angle relative to the longitudinal direction of the wall slide bar 11.

FIG. 4A and FIG. 4B, shows respectively the movement of the shower holding device 10 in a downward and upward direction along the wall slide bar 11. The operator moves the shower holding device 10 in a downward direction shown in FIG. 4A by depressing the button 60 and pushing the shower holding device 10 in the downward direction. Oppositely the operator moves the shower holding device 10 in an upward direction shown in FIG. 4B by depressing the button 62 and pushing the shower holding device 10 in the upward direction.

FIG. 4A further shows a showerhead 76 mounted in the revolving shower holder 68. The showerhead 76 is mounted in the revolving shower holder 68 by sliding a hose 80 connected to the revolving shower holder 68 through a slit in the revolving shower holder 68 and lowering the showerhead 76 having a conical shape down in the slit thus fixating the showerhead in the revolving shower holder 68. The hose 80 is connected to the revolving shower holder 68 by a connector 78, which will be described in detail with reference to FIG. 5.

FIG. 5, shows the connector 78 connecting the showerhead 76 to the hose 80, which connector 78 pivots freely around the longitudinal axis of the connector 78. The connector 78 defines a conical open cylindrical shape having the smaller diameter pointing towards the hose 80 and the large diameter pointing towards the showerhead 76. The connector 78 comprises an inner threading 82 for receiving an outer threading 84 on the showerhead 76. The hose 80 is terminated with an end piece 86 having a smooth circular surface, which allows the connector 78 to swivel around the longitudinal axis of the hose 80. The distal end of the end piece 86 has a slightly increased diameter relative to the hose 80 in general and relative to the smallest diameter of the connector 78 thus preventing the connector 78 to escape the hose 80. Between the connector 78 and the showerhead 76 a set of spacers and/or washers 92, 94 are inserted for providing a low friction connection thus enabling swivelling of the connector 78 and the showerhead 76 relative to the hose 80. The spacers and/or washers 92, 94 may be implemented in any material providing a low interrelating friction e.g. any plastic material.

What is claimed is:

1. A shower holding device for fixating a showerhead in a specific position along a longitudinal direction of a wall slide bar, said shower holding device comprising:

(a) a casing defining a top surface and a bottom surface each extending transversely relative to said longitudinal direction of said wall slide bar and having an open ended cylindrical bore extending through said casing from said top surface to said bottom surface for receiving said wall slide bar, (b) braking means engaging with said wall slide bar thereby fixating said shower holding device at said specific position along said longitudinal direction of said wall slide bar (c) a set of parallelly acting pushbuttons independently co-operating with said braking means and each of said set of parallelly acting pushbuttons engaging in a first position said braking means for fixating said shower holding device at said specific position along said longitudinal direction of said wall slide bar and disengaging in a second position said braking means for allowing movement of said shower holding device along said longitudinal direction of said wall slide bar, and said set of pushbuttons being constituted by a first pushbutton located on said top surface of said casing and a second pushbutton located on said bottom surface of said casing, said first pushbutton being independently depressible in a first direction substantially parallel to said longitudinal direction of said wall slide bar and toward said bottom surface of said casing obtaining said second position of said first pushbutton and said second pushbutton independently being depressible in a second direction substantially parallel to said longitudinal direction of said wall slide bar and toward said top surface of said casing obtaining said second position of said second pushbutton.

2. A shower holding device according to claim 1, wherein a force exerted on said first or said second pushbutton for depressing either of said set of pushbuttons in said second position for disengaging said braking means is larger than the frictional force between said wall slide bar and said shower holding device when said braking means are disengaged so that depressing said first pushbutton in said second position disengages said braking means and causes movement of said shower holding device in said second direction and so that depressing said second pushbutton in said second position disengages said braking means and causes movement of said shower holding device in said first direction.

3. A shower holding device according to claim 1, wherein said wall slide bar has a cross-sectional shape selected from the group consisting of rectangular, triangular, elliptical, circular, semi-elliptical, and semi-circular.

4. A shower holding device according to claim 1, wherein said wall slide bar is constructed of a material selected from the group consisting of plastics, metals, and combinations of plastics and metals; and wherein the casing is constructed of a material selected from the group consisting of plastics, metals, and combinations of plastics and metals.

5. A shower holding device according to claim 1, wherein said shower holding device further comprising bushing means for mounting in said open ended cylindrical bore, said bushing means having an inner bore with a cross sectional shape snugly matching a cross sectional shape of said wall slide bar.

6. A shower holding device according to claim 1, wherein said first and second pushbuttons co-operating with said braking means through a pair of axles having asymmetrical cross sections so that adding pressure to said first and/or second pushbuttons induces rotation of said pair of axles providing a first displacement of said braking means to engage said wall slide bar in said first position of said first and second pushbuttons and so that releasing pressure on said first and/or second pushbuttons induces rotation of said pair of axles providing a second displacement of said braking means to disengage said wall slide bar in said second position of said first and second pushbuttons.

7. A shower holding device according to claim 6, wherein said braking means comprising a first braking pad engaging said wall slide bar in said first position of said first and second pushbuttons and comprising a second braking pad providing fixture of said showerhead so that said first displacement of said braking means provides fixation of said shower holding device along said longitudinal direction of said wall slide bar and enables angular stepwise rotation of said showerhead and so that said second displacement of said braking means provides movement of said shower holding device along said longitudinal direction of said wall slide bar and angular fixation of said showerhead.

8. A shower holding device according to claim 1, wherein said showerhead is received in a revolving shower holder having teeth extending outwardly from said receiving shower holding into matching teeth in said casing so as to enable angular fixation of said showerhead.

9. A shower holding device according to claim 1, wherein said showerhead comprising a showerhead connector for connecting said showerhead to a hose, said showerhead connector having a conical shaped open ended first part defining a first end diameter larger than a second end diameter, having said first part axially fixated at said second end diameter to said hose by utilising a hose section defining an end surface having a larger diameter than said second end diameter, having a plurality of washers or spacers interconnecting said hose section with said showerhead, and having said first part connected to said showerhead at said first end diameter, said plurality of washers or spacers sealing said connector and simultaneously enabling axial rotation of said showerhead relative to said hose.

10. A shower holding assembly comprising (d) a hose for connecting to a water mixing fitting, (e) a showerhead for ejecting water, (f) a connector for connecting said showerhead to said hose, (g) a wall slide bar for mounting on a wall in a bath room, (h) a shower holding device for fixating said showerhead in a specific position along a longitudinal direction of said wall slide bar, said shower holding device comprising:

(i) a casing defining a top surface and a bottom surface each extending transversely relative to said longitudinal direction of said wall slide bar and having an open ended cylindrical bore extending through said casing from said top surface to said bottom surface for receiving said wall slide bar, (ii) braking means engaging with said wall slide bar thereby fixating said shower holding device at said specific position along said longitudinal direction of said wall slide bar, (iii) a set of parallel acting pushbuttons independently co-operating with said braking means and each of said set of parallel acting pushbuttons engaging in a first position said braking means fixating said shower holding device to said specific position along said longitudinal direction of said wall slide bar and disengaging in a second position said braking means allowing movement of said shower holding device along said longitudinal direction of said wall slide bar, and said set of pushbuttons being constituted by a first pushbutton located on said top surface of said casing and a second pushbutton located on said bottom surface of said casing, said first pushbutton being independently depressible in a first direction substantially parallel to said longitudinal direction of said wall slide bar and toward said bottom surface of said casing obtaining said second position of said first pushbutton and simultaneously causing movement of said casing in said first direction and said second pushbutton being independently depressible in a second direction substantially parallel to said longitudinal direction of said wall slide bar and toward said top surface of said casing obtaining said second position of said second pushbutton and simultaneously causing movement of said casing in said second direction.

* * * * *